US008100042B2

(12) United States Patent
Chen

(10) Patent No.: US 8,100,042 B2
(45) Date of Patent: Jan. 24, 2012

(54) ADHESIVE TAPE CANISTER

(75) Inventor: Yun-Jing Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 314 days.

(21) Appl. No.: 12/548,448

(22) Filed: Aug. 27, 2009

(65) Prior Publication Data

US 2011/0036503 A1 Feb. 17, 2011

(30) Foreign Application Priority Data

Aug. 13, 2009 (CN) ..... 2009 1 0305572

(51) Int. Cl.
*B65H 35/07* (2006.01)

(52) U.S. Cl. ..... 83/649; 83/611; 225/66; 225/89; 30/131

(58) Field of Classification Search ..... 83/649, 83/650, 610, 611, 440.1; 225/43, 46, 56, 225/65–67, 89; 30/124, 131–135, 182; 206/411; 156/19–20, 577, 579, 527, 510, 511
See application file for complete search history.

(56) References Cited

U.S. PATENT DOCUMENTS

| | | | | |
|---|---|---|---|---|
| 2,604,166 | A * | 7/1952 | Turner | 83/611 |
| 3,101,538 | A * | 8/1963 | Dewyer | 83/649 |
| 3,745,086 | A * | 7/1973 | Parker | 156/527 |
| 4,344,813 | A * | 8/1982 | Holoff et al. | 156/527 |
| 6,484,919 | B2 * | 11/2002 | Ho | 225/13 |
| 6,789,594 | B1 * | 9/2004 | Yu Chen | 156/523 |
| 7,320,351 | B2 * | 1/2008 | Chern | 156/523 |

* cited by examiner

*Primary Examiner* — Laura M. Lee
(74) *Attorney, Agent, or Firm* — Altis Law Group, Inc.

(57) ABSTRACT

An adhesive tape canister includes a reel to mount a roll of adhesive tape. When the adhesive tape needs to be cut, a handle portion of the adhesive tape canister is pressed, a first blade is moved towards the second blade. The adhesive tape can be cut by the first blade and the second blade in response to the first blade moving to the second blade.

4 Claims, 3 Drawing Sheets

ADHESIVE TAPE CANISTER

BACKGROUND

1. Technical Field

The present disclosure relates to holding apparatuses and, particularly, to an adhesive tape canister for holding a roll of adhesive tape.

2. Description of Related Art

An adhesive tape spool with a roll of adhesive tape is positioned on an ordinary adhesive tape canister, and the adhesive tape is generally cut by a sawtooth of the adhesive tape canister. However, the adhesive tape may be broken by the sawtooth when a force for pulling the adhesive tape is improper. In addition, because the adhesive tape is cut by the sawtooth, the adhesive tape may not be cut neatly.

DETAILED DESCRIPTION

Figure 1:
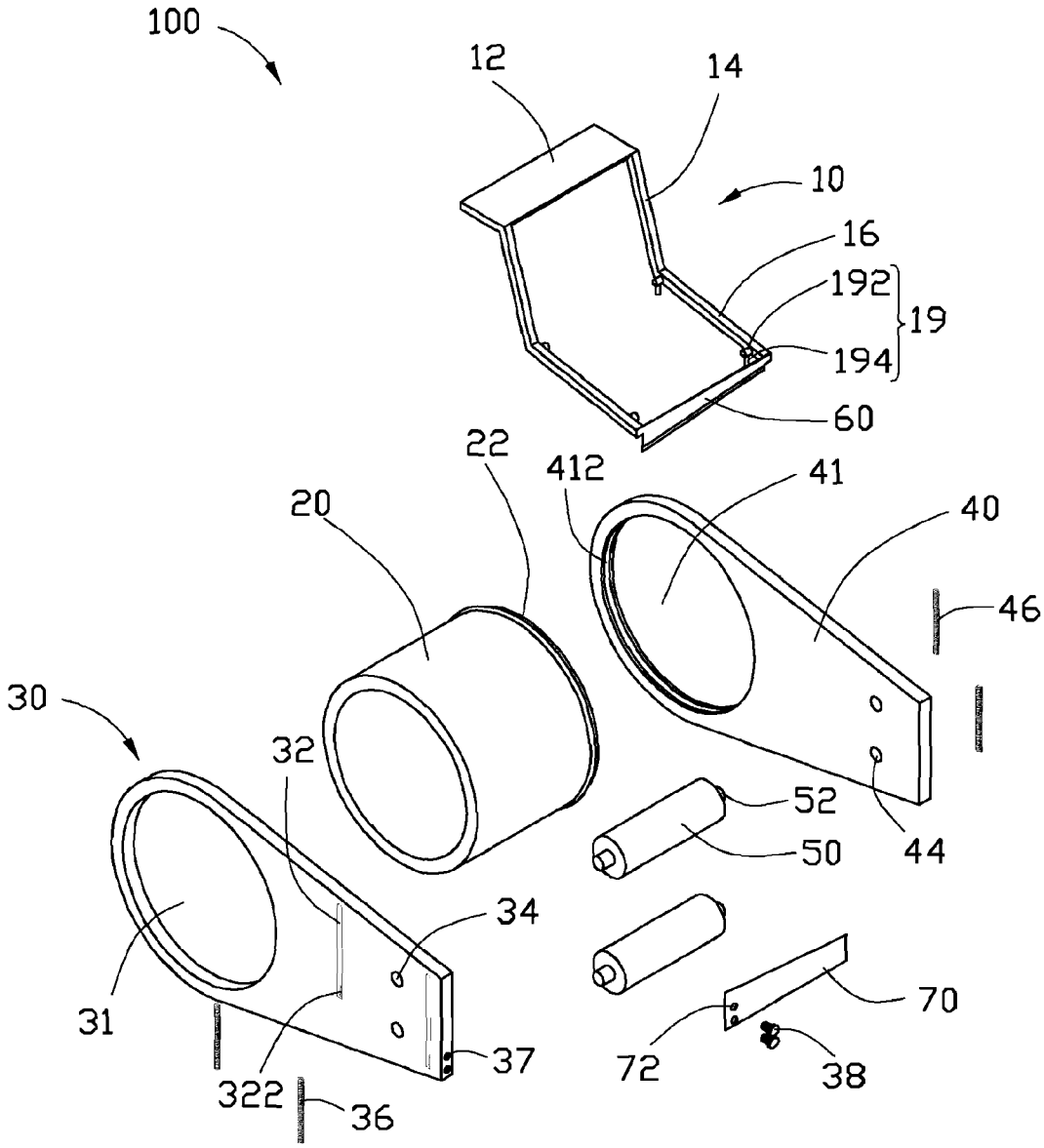
FIG. 1 is an exploded, isometric view of an exemplary embodiment of an adhesive tape canister.

Referring to FIG. 1, an exemplary embodiment of an adhesive tape canister 100 includes a pressing element 10, a reel 20 to mount an adhesive tape spool 80 with a roll of adhesive tape 82 (see FIG. 3), a supporting module, and two rollers 50. The supporting module includes a first supporting element 30 and a second supporting element 40.

The pressing element 10 includes a rectangular-shaped handle portion 12, two first actuators 14 slantingly extending down from opposite ends of a side of the handle portion 12, and two second actuators 16 which are approximately parallel with the handle portion 12 extending from distal ends of the first actuators 14 correspondingly. A first blade 60 is fixed to distal ends of the two second actuators 16. A bottom side of the first blade 60 forming an edge of the first blade 60. Two T-shaped latching portions 19 extend from opposite ends of an inner side of each of the second actuators 16 correspondingly. Each of the latching portions 19 includes a horizontal protrusion 192 and a vertical protrusion 194 extending down from a center of the horizontal protrusion 192.

The reel 20 is a hollow cylinder. An annular projection 22 extends from a circumference of an end of the reel 20.

The first supporting element 30 defines a circular opening 31 in a first end for receiving the reel 20, and two parallel slide grooves 32 in a second end opposite to the first end of the first supporting element 30 correspondingly. Two positioning holes 34 are defined in the first supporting element 30 between the slide grooves 32. An end face at the second end of the first supporting element 30 defines two screw holes 37, for mounting a second blade 70. A raised portion 322 is formed in a bottom end of each slide groove 32 to fittingly sleeve a bottom end of a spring 36. The second blade 70 defines two through holes 72 in an end of the second blade 70, corresponding to the screw holes 37 of the first supporting element 30. A top side of the second blade 70 forms an edge of the second blade 70.

The second supporting element 40 has a shape similar to the first supporting element 30, and defines a circular opening 41, two slide grooves (not shown), and two positioning holes 44. Each of the slide grooves may accommodate a spring 46.

A difference between the second supporting element 40 and the first supporting element 30 is that the second supporting element 40 further defines a circular notch 412 in an inner wall bounding the opening 41 corresponding to the projection 22 of the reel 20.

Each of the rollers 50 is a cylinder. Two posts 52 extend from opposite ends of the roller 50.

Figure 2:
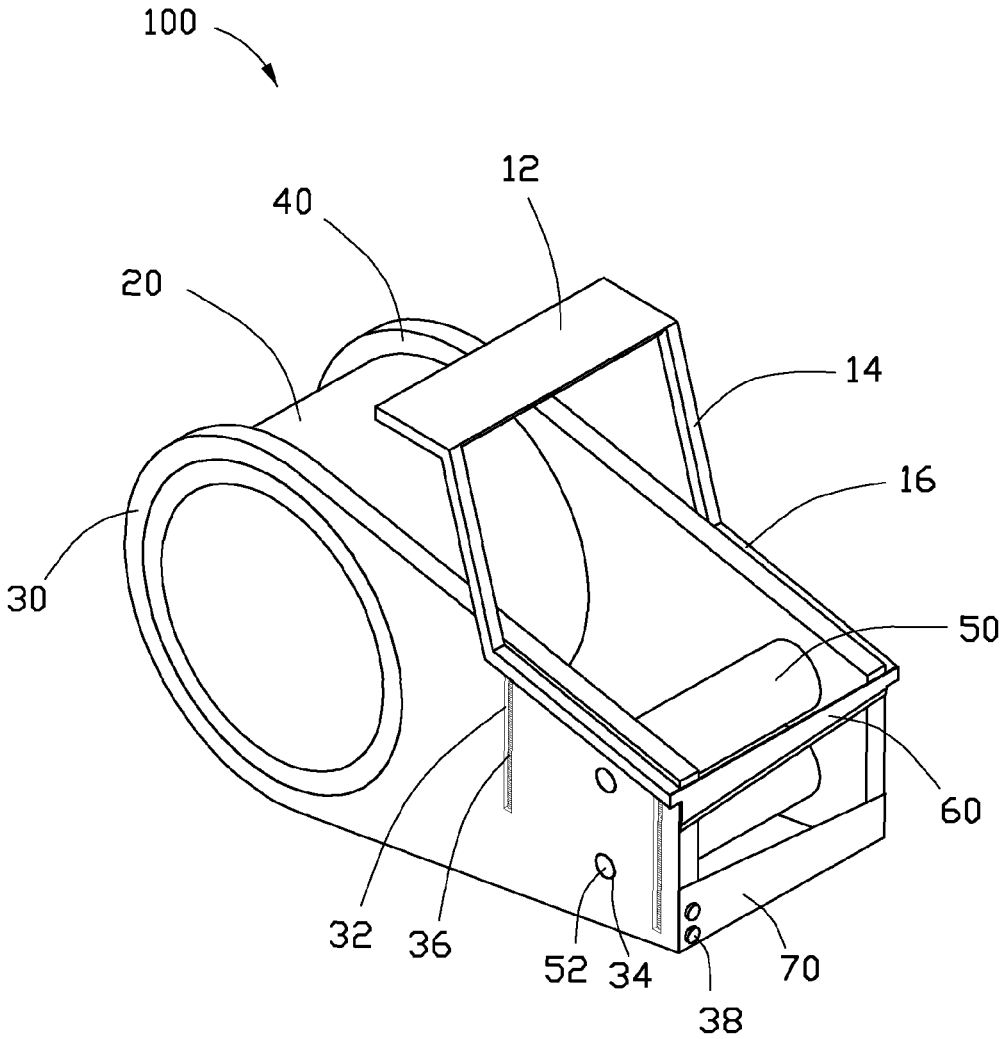
FIG. 2 is an assembled view of the adhesive tape canister of FIG. 1.

Referring to FIG. 2, in assembly, the rollers 50 are positioned between the first and second supporting elements 30, 40 via the posts 52 of the rollers 50 being rotatably engaged in the positioning holes 34 and 44 correspondingly. Two screws 38 are inserted into the through holes 72 of the second blade 70 correspondingly, and screwed into the corresponding screw holes 37 of the first supporting element 30. Therefore, the second blade 70 is mounted to the first supporting element 30. The springs 36, 46 are corresponding arranged in the slide grooves 32 of the first supporting element 30 and the slide grooves of the second supporting element 40, with the bottom ends of the springs 36 and 46 sleeved on the raised portion 322 of the first supporting element 30 and the raised portion of the second supporting element 40 correspondingly. The latching portions 19 of the pressing element 10 are slidably arranged in the slide grooves 32 of the first supporting element 30 and the slide grooves of the second supporting element 40, with top ends of the springs 36 and 46 sleeving on the vertical protrusions 194 and resisting against the horizontal protrusions 192 of the corresponding latching portions 19. The two second actuators 16 are positioned at outsides of the first supporting element 30 and the second supporting element 40. The first blade 60 is located at the second ends of the first supporting element 30 and the second supporting element 40, opposite to the second blade 70. The reel 20 is inserted into the opening 41 of the second supporting element 40 and the opening 31 of the first supporting element 31, with the projection 22 of the reel 20 engaged in the notch 412 of the second supporting element 40. The reel 20 is rotatable relative to the first and second supporting elements 30 and 40.

Figure 3:
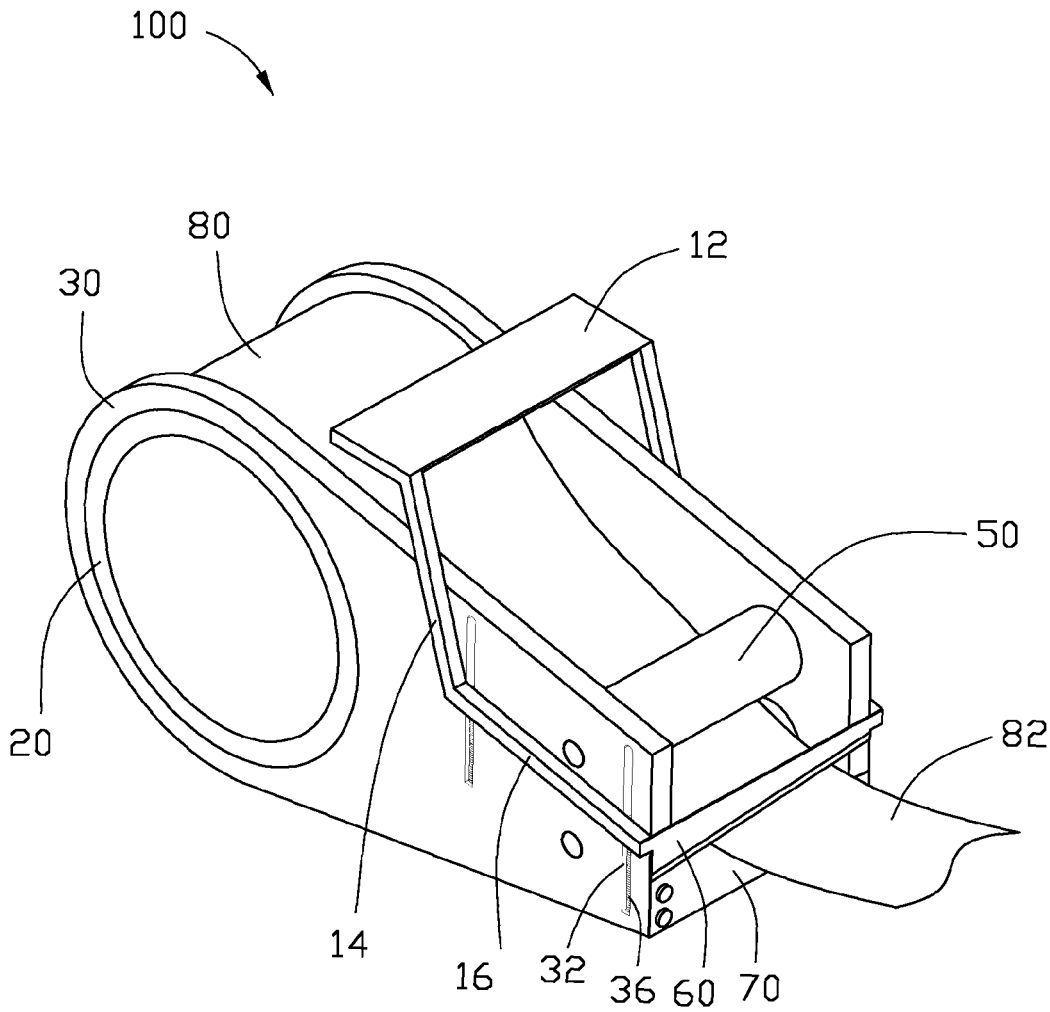
FIG. 3 is similar to FIG. 2, but showing a using state of the adhesive tape canister.

Referring to FIG. 3, in use, the reel 20 is removed away from the first supporting element 30 and the second supporting element 40, the adhesive tape spool 80 is inserted into the canister 100 and aligned with the openings 31 and 41. The reel 20 is arranged to the first supporting element 30 and the second supporting element 40 again and passes through the tape spool 80. The adhesive tape 82 is pulled out between the rollers 50, as a result the reel 20 moves relative to the first and second supporting members 30 and 40. When the adhesive tape 82 needs to be cut, the handle portion 12 is pressed down, the latching portions 19 slide down in the slide grooves 32 of the first supporting member 30 and the slide groove of the second supporting element 40 to deform the springs 36 and 46, thereby the first blade 60 moves towards the second blade 70. The adhesive tape 82 is cut off by the first blade 60 and the second blade 70 when the first blade 60 moves to the second blade 70. After the adhesive tape 82 is cut, the handle portion 12 is released, the springs 36 and 46 restores and drives the first blade 60 to return to an initial position of the first blade 60. The adhesive tape canister 100 can easily cut the adhesive tape 82 of the adhesive tape canister 80 arranged on the adhesive tape canister 100, and the adhesive tape 82 is cut neatly.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An adhesive tape canister for holding a roll of adhesive tape, comprising:

a reel to mount the adhesive tape roll;

a pressing element comprising a first blade; and a supporting module comprising a second blade facing the first blade;

wherein the reel is arranged on a first end of the supporting module, the pressing element is slidably mounted to a second end of the supporting module via an elastic element, the first blade is moved to the second blade to cut the adhesive tape pulled between the first and second blades in response to the pressing element being pressed; the supporting module comprises a first supporting element and a second supporting element, the elastic element comprises four springs, the first and second supporting elements each define two parallel slide grooves for accommodating the corresponding springs, the pressing element comprises a handle portion, two first actuators extending from opposite ends of a side of the handle portion, and two second actuators which are approximately parallel with the handle portion extending from distal ends of the first actuators, and wherein four latching portions extend from inner sides of ends of the second actuators, and are slidably accommodated in the corresponding slide grooves and resisting against the corresponding springs.

2. The adhesive tape canister of claim 1, wherein a raised portion extends from a bottom of each of the slide grooves, a first end of each spring fits about the raised portion of a corresponding slide groove, each of the latching portions comprises a horizontal protrusion extending from the corresponding second actuator and a vertical protrusion extending from the horizontal protrusion, a second end of each spring fits about the vertical protrusion of a corresponding latching portion.

3. The adhesive tape canister of claim 1, wherein the first blade is fixed to distal ends of the two second actuators, a first edge of the first blade is formed on a bottom of the first blade, the second blade is fixed to a bottom of the first supporting element, a second edge of the second blade is formed on a top of the first blade, opposite to the first edge of the first blade.

4. The adhesive tape canister of claim 1, further comprising two rollers, two posts extending from opposite ends of each of the rollers, wherein the first and second supporting elements each define two positioning holes, the rollers are mounted between the first and second supporting elements, with the posts of the rollers rotatably engaged in the positioning holes of the first and second supporting elements respectively, allowing the adhesive tape passing between the rollers.

* * * * *